US010505259B2

(12) United States Patent
Le et al.

(10) Patent No.: US 10,505,259 B2
(45) Date of Patent: Dec. 10, 2019

(54) MULTI-ELEMENT TELECOMMUNICATIONS ANTENNA

(71) Applicant: CSS Antenna, LLC, Edgewood, MD (US)

(72) Inventors: Kevin T. Le, Bel Air, MD (US); William J. Brown, Sykesville, MD (US); Jordan E. Ragos, Abingdon, MD (US); Shawn M. Chawgo, Cicero, NY (US)

(73) Assignee: CSS Antenna, LLC (A JMA Company), Edgewood, MD (US)

( * ) Notice: Subject to any disclaimer, the term of this patent is extended or adjusted under 35 U.S.C. 154(b) by 94 days.

(21) Appl. No.: 15/240,325

(22) Filed: Aug. 18, 2016

(65) Prior Publication Data

US 2017/0054198 A1 Feb. 23, 2017

Related U.S. Application Data

(60) Provisional application No. 62/206,485, filed on Aug. 18, 2015.

(51) Int. Cl.
*H01Q 1/24* (2006.01)
*H01Q 1/00* (2006.01)
(Continued)

(52) U.S. Cl.
CPC ..... *H01Q 1/243* (2013.01); *H01Q 1/007* (2013.01); *H01Q 1/48* (2013.01); *H01Q 1/521* (2013.01);
(Continued)

(58) Field of Classification Search
CPC ..... H01Q 1/243; H01Q 1/521; H01Q 9/065; H01Q 9/285; H01Q 1/48; H01Q 1/007; H01Q 21/28; H01Q 21/30
See application file for complete search history.

(56) References Cited

U.S. PATENT DOCUMENTS 5,952,983 A 9/1999 Dearnley et al.
6,195,063 B1 * 2/2001 Gabriel ..... H01Q 1/523 343/700 MS
(Continued)

OTHER PUBLICATIONS

European Patent Office, Extended European Search Report (EESR) from EP patent application No. 16184766.0 dated Apr. 18, 2017.
(Continued)

*Primary Examiner* — Hoang V Nguyen
*Assistant Examiner* — Awat M Salih
(74) *Attorney, Agent, or Firm* — Barclay Damon LLP

(57) ABSTRACT

A telecommunications antenna comprising a conductive ground plane and at least one pair of broadband radiators mounted, and electrically connected, to the conductive ground plane. Each of the broadband radiators includes first and second dipole elements wherein the first dipole element is tuned to a first broadband frequency and the second dipole element is tuned to a second broadband frequency. At least one of the dipole elements associated with one broadband radiator is spatially positioned relative to the respective dipole element of the other broadband radiator to minimize electrical coupling therebetween. Dipole elements tuned to the same frequency on each broadband radiator are oriented orthogonally to mitigate electrical coupling across the dipole elements.

21 Claims, 7 Drawing Sheets

(51) Int. Cl.

| | |
|---|---|
| ***H01Q 1/52*** | (2006.01) |
| ***H01Q 9/28*** | (2006.01) |
| ***H01Q 21/28*** | (2006.01) |
| ***H01Q 1/48*** | (2006.01) |
| ***H01Q 9/06*** | (2006.01) |
| ***H01Q 21/00*** | (2006.01) |
| ***H01Q 5/48*** | (2015.01) |
| *H01Q 21/30* | (2006.01) |

(52) U.S. Cl.
CPC ..... *H01Q 5/48* (2015.01); *H01Q 9/065* (2013.01); *H01Q 9/285* (2013.01); *H01Q 21/00* (2013.01); *H01Q 21/28* (2013.01); *H01Q 21/30* (2013.01)

(56) References Cited

U.S. PATENT DOCUMENTS

| | | | | |
|---|---|---|---|---|
| 2005/0200543 | A1 | 9/2005 | Shtrikman et al. | |
| 2012/0003946 | A1* | 1/2012 | Ono ..... | H01Q 3/30 455/115.1 |
| 2012/0062437 | A1 | 3/2012 | Hung et al. | |
| 2014/0022131 | A1 | 1/2014 | Azulay et al. | |
| 2014/0327591 | A1 | 11/2014 | Kokkinos | |
| 2015/0116174 | A1 | 4/2015 | Yona et al. | |

OTHER PUBLICATIONS

European Patent Office, Extended European Search Report from EP Application No. 16 184 766.0 dated Jan. 12, 2017 (total 8 pages).
European Patent Office, Office Action issued in EP Patent Application No. 16184766.0, dated May 7, 2018 (5 pages).

* cited by examiner

MULTI-ELEMENT TELECOMMUNICATIONS ANTENNA

CROSS REFERENCE TO RELATED APPLICATIONS

This application is a non-provisional patent application, and claims the benefit and priority, of U.S. Provisional Patent Application No. 62/206,485 filed on Aug. 18, 2015. The entire contents of such application are hereby incorporated by reference.

TECHNICAL FIELD

This application relates to an antenna for use in telecommunications systems and, more particularly, to a new and useful tailored multi-element antenna system which minimizes electrical coupling and signal interference. In another embodiment the antenna comprises a multiple input, multiple-output phase shifter to provide a directional beam pattern over a specific geographic region.

BACKGROUND

Typical cellular systems divide geographical areas into a plurality of adjoining cells, each cell including a wireless cell site or "base station." The cell sites operate within a limited radio frequency band and, accordingly, carrier frequencies must be used efficiently to ensure sufficient user capacity in the system.

Call carrying capacity for cellular networks involves the creation of base stations or cell sites across various geographic regions/areas. The base stations/cell sites are partitioned based upon user density/location and, consequently, service providers must purchase real estate and equipment for each site. A base station may provide omni-directional coverage or directional coverage based upon the geography of a particular site. For example, a site may be centrally-located in an open area, void of tall buildings/structures/mountains, such that an omni-directional antenna may be the most efficient arrangement for providing coverage in a particular geographic region. If a mountain range has caused geographic development along one of its sides, then a directional antenna may be best-suited for providing coverage to cellular customers residing on that side of the mountain range. If an area is heavily developed, such as in an urban setting, an antenna which produces a circular, downwardly-directed beam may provide the most efficient cellular coverage for the area. In the case of heavily populated areas, a beam pattern comprising a plurality of lobes may provide the best coverage. Notwithstanding the type of coverage provided by the individual cell sites, one of the more important considerations involves minimizing overlap between adjacent lobes to minimize interference between cell sites.

To improve the quality and reliability of wireless systems, service providers often rely on antenna "diversity" and antenna "polarization." Diversity improves the ability of an antenna to see an intended signal around natural geographic features of a landscape, including man-made structures such as high-rise buildings. A diversity antenna array helps to increase coverage as well as to overcome fading. Antenna polarization combines pairs of antennas with orthogonal polarizations to improve base station uplink gain. Given the random orientation of a transmitting antenna, when the signal of one diversity-receiving antenna fades due to the receipt of a weak signal, the probability is high that the signal of other diversity-receiving antenna will strengthen. With respect to antenna polarization, most communications systems use vertical, slant and/or circular polarization.

Beam Shaping is another technique employed to optimize call carrying capacity by providing the most available carrier frequencies within demanding geographic environments. Oftentimes user demographics change such that base transceiver stations have insufficient capacity to deal with current local demand within an area. For example, a new housing development within a cell may increase demand within that specific area. Beam shaping can address this problem by distributing the traffic among the transceivers to increase coverage in the demanding geographic sector.

Prior art beam shaping solutions utilize complex beam-forming devices (LPAs, controllable phase shifters, etc.), many of which are not well-suited for deployment atop a masthead or cell tower. A significant design effort involves the use of 2- and 3-sector antennas optimized to provide beam-forming for the purpose of increasing "long term evolution" (4G LTE) data rates in a small cellular network.

Of the various antenna systems employed, Single Input, Single Output (SISO), Single Input, Multiple Output (SIMO), Multiple Input, Single Output, (MISO) and Multiple Input, Multiple Output (MIMO) antenna systems are, by far, the most common. Single Input, Single Output (SISO) antenna are somewhat self-explanatory inasmuch as the antenna employs a single transmitter for sending signals and a single receiver for accepting signals. To multiply the capacity of a radio link, SIMO and MISO telecommunications antennas utilize multiple transmit and/or multiple receive antennas to exploit multipath propagation technology. For example, such technology refers to a practical technique for sending and receiving more than one data signal on the same radio channel at the same time via multipath propagation. Moreover, such telecommunication system are fundamentally different from smart antenna techniques developed to enhance the performance of a single data signal, such as the techniques employed in beamforming and beam diversity.

While telecommunications systems can provide an ability to increase system capacity, the multiple antennas employed therein must be spaced-apart to provide proper isolation between each antenna. Inasmuch as the antenna spacing increases the overall size/diameter of the telecommunications antenna, service providers often impose size constraints which prohibit the type/size of certain antenna. That is, the geometry of a telecommunications antenna is oftentimes too large to fit within the spatial envelope stipulated by the building occupants, residents, service providers, etc.

Furthermore, monopole antennas of the prior art propagate energy in the one-half wavelength (½)(λ) which corresponds to about seven and four-tenth inches (7.4.") Hence, a full wave-length radiators will be more than about fourteen and eight-tenths inches (14.8"). Since the maximum/desired envelope of certain canister antennas is only about six inches (6.0"), typical low-band radiators are generally dismissed as being too large for such applications.

The foregoing background describes some, but not necessarily all, of the problems, disadvantages and shortcomings related to telecommunications antennas.

SUMMARY

An antenna is provided to exchange signals in the broadband range of the electromagnetic spectrum, comprising: a conductive ground plane and at least one pair of broadband radiators mounted to the conductive ground plane. Each of the broadband radiators includes first and second dipole elements wherein the first dipole element is tuned to a first broadband frequency and the second dipole element is tuned to a second broadband frequency. At least one of the dipole elements associated with one broadband radiator is spatially positioned relative to the respective dipole element of the other broadband radiator to minimize electrical coupling therebetween. In the described embodiment, the dipole elements tuned to the same frequency on each of the broadband radiators are oriented orthogonally to the mitigate electrical coupling across the dipole elements.

In another embodiment, a telecommunications antenna is provided for use in combination with a Multiple Input, Multiple Output (MIMO) antenna. This telecommunications antenna comprises a conductive ground plane, and first and second dipole elements each mounted, and electrically connected, to the conductive ground plane. The first and second dipole elements each have a length dimension tuned to a broadband frequency wherein the broadband frequency of the second dipole element is higher than the broadband frequency of the first dipole element. Additionally, the first dipole element crosses the second dipole element along a vertical line substantially normal to the ground plane and has a shorter length dimension than the second dipole element.

Additional features and advantages of the present disclosure are described in, and will be apparent from, the following Brief Description of the Drawings and Detailed Description.

DETAILED DESCRIPTION

The telecommunications antenna of the present invention will be described in the context of a Single Input, Single Output (SISO), Single Input, Multiple Output (SIMO), Multiple Input, Single Output (MISO) antenna system, however, it should be appreciated that the invention is also applicable to a Multiple Input, Multiple Output (MIMO) telecommunication antennas. Further, while a telecommunications antenna having four dipole assemblies or broadband radiators is described, the telecommunications antenna may have any number of antennas to exchange broadband signals to and from cellular devices.

Figure 1:
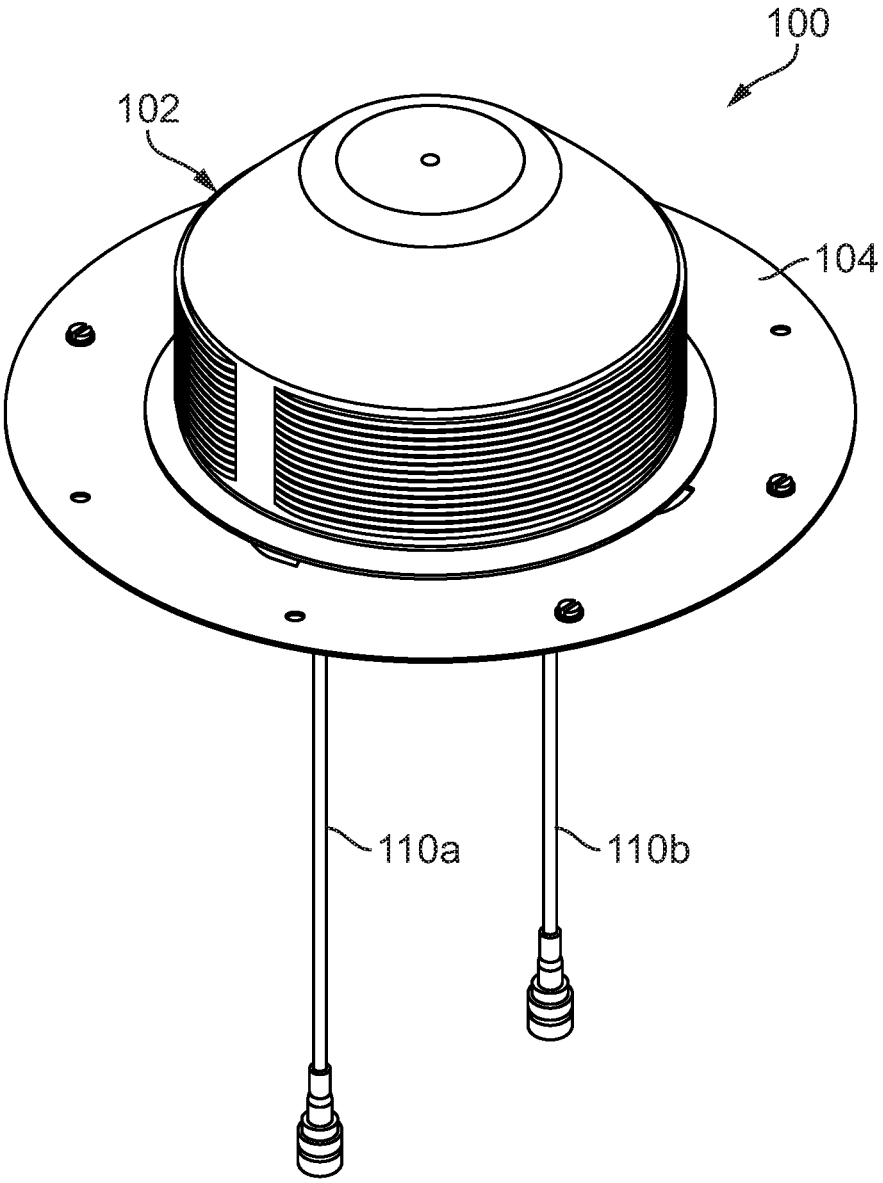
FIG. 1 is a perspective view of a telecommunications antenna mounted internally of a canister housing which is integrated within a ceiling structure of a conventional office or commercial building.

In FIG. 1, a telecommunications antenna 100 is mounted within a ceiling structure of a conventional office or commercial building. The telecommunications antenna 100 includes an outer housing 102 which is transparent to electromagnetic energy for exchanging broadband signals to and from cellular customers/devices. The housing 102 is limited in size to about eight inches (8") in diameter and about six inches (6") in height. As mentioned in the background of the invention, building residents and service providers often mandate or stipulate that the size of such antennas be limited/minimized to maintain the overall building aesthetics while mitigating concerns regarding occupant exposure to harmful levels of RF radiation.

Figure 2:
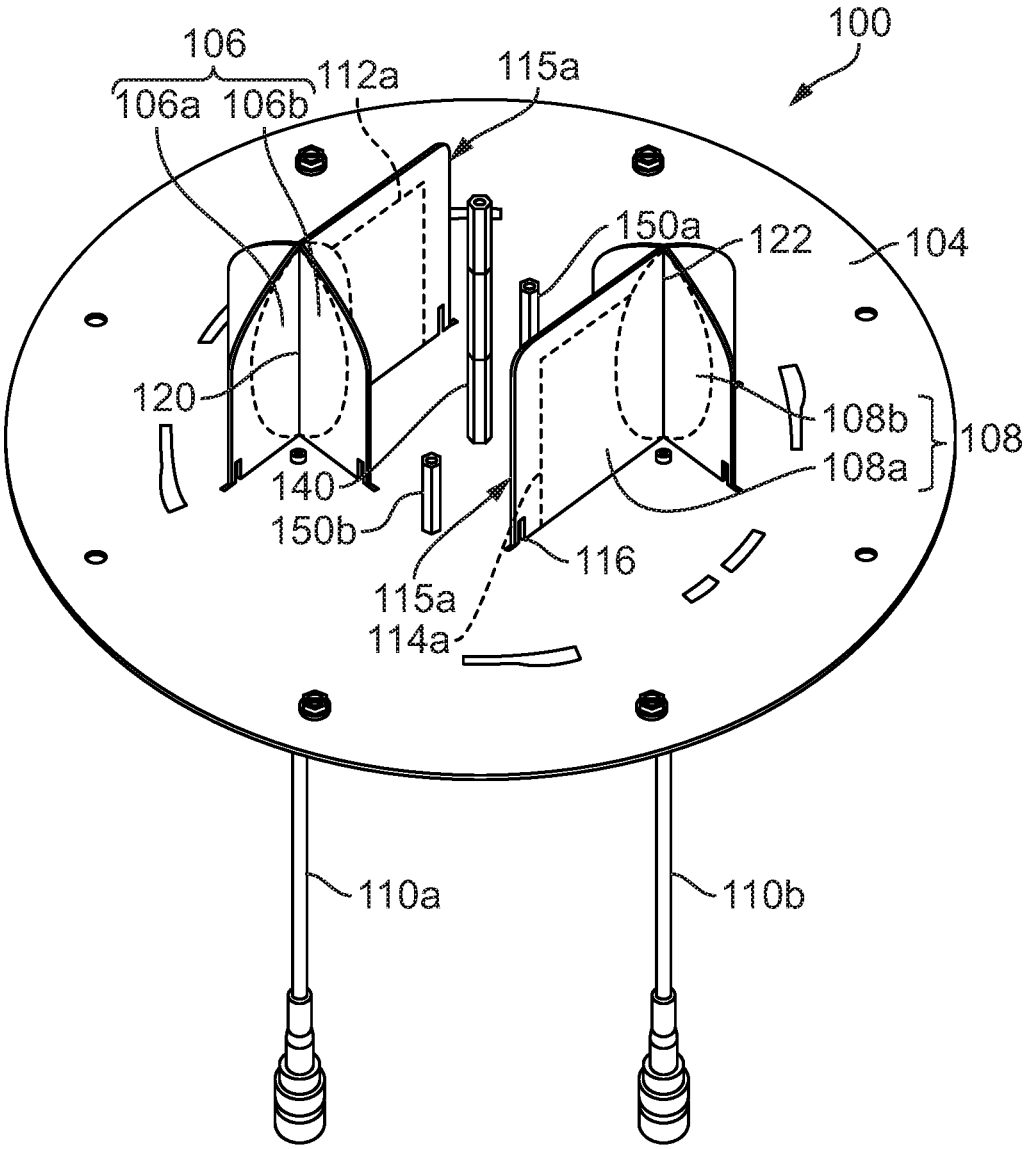
FIG. 2 is a perspective view of the internal components of the telecommunications antenna including a pair of broadband radiators each employing a first dipole element tuned to a first broadband frequency and a second dipole element tuned to a second broadband frequency.

In FIG. 2, the telecommunications antenna 100 includes a generally planar, conductive base plate 104 having mounted thereto a pair of dipole assemblies or broadband radiators 106, 108 each comprising a first dipole, leg or radiating element 106*a*, 108*a* and a second dipole, leg, or radiating element 106*b*, 108*b* (hereinafter referred to as "dipole elements"). The first and second dipole elements 106*a*, 106*b*, 108*a*, 108*b* project outwardly from the base plate 104, and, in the illustrated embodiment, project orthogonally, or at right angles relative to, the base plate 104. Jumper cables 110*a*, 110*b* exchange broadband signals between ports (not shown) along the underside of the telecommunications antenna 100 and a Distributed Antenna System (DAS).

In the broadest sense of the invention, the first dipole elements 106*a*, 108*a* of the dipole assemblies or broadband radiators 106, 108 are configured to be tuned to a first frequency while the second dipole elements 106*b*, 108*b* thereof are configured to be tuned to a second frequency. In the described embodiment, the second dipole elements 106*b*, 108*b* are configured to be tuned to a second frequency higher than the first frequency. As a consequence of this teaching, the first dipole elements 106*a*, 108*a* are longer, i.e., in spanwise length dimension, than the length dimension of the second dipole elements 106*b*, 108*b*. That is, since tuning is a function of the quarter-wavelength (¼)(λ) of the target frequency (v), the lower frequency/longer wavelength of the first dipole elements 106*a*, 108*a* will necessarily be longer than the higher frequency/shorter wavelength of the second dipole elements 106*b*, 108*b*.

Figure 3:
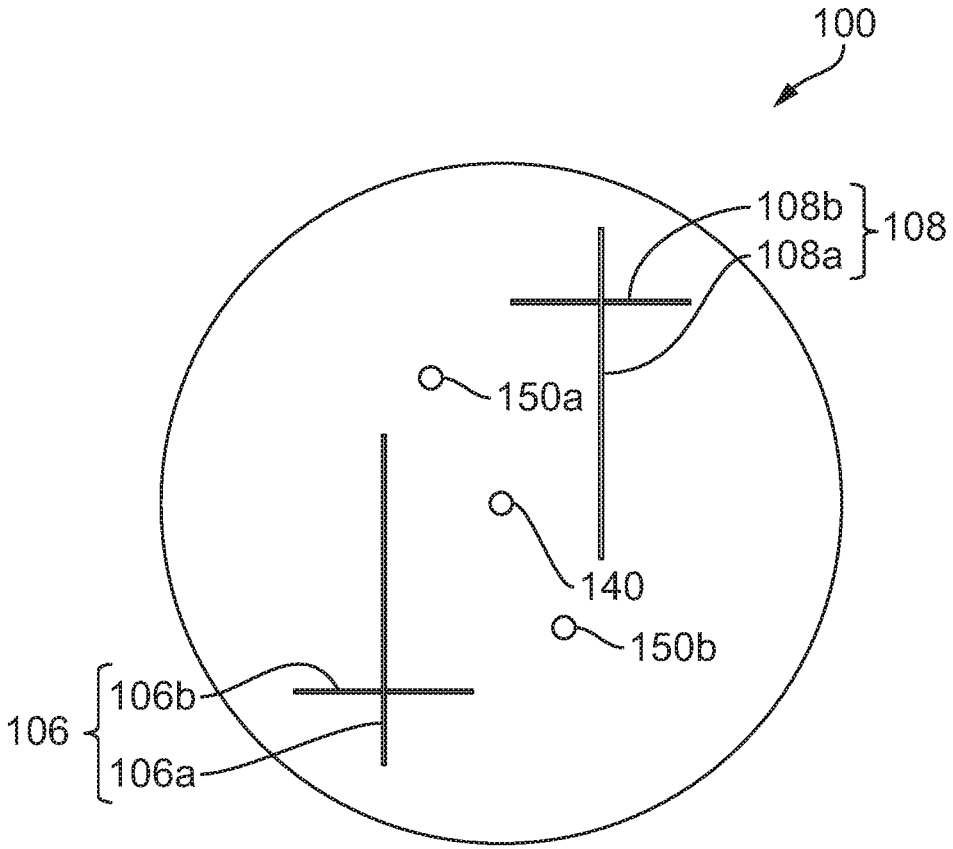
FIG. 3 is a top view of the telecommunications antenna wherein the first of the dipole elements associated with one of the broadband radiators is orthogonal to, i.e., disposed at right angles relative to, the first dipole elements of the other broadband radiators to minimize electrical coupling between the first dipole elements.

In FIGS. 2 and 3, the first and second dipole elements 106*a*, 108*a*, 106*ba*, 108*b* are generally metallic and conductive. Furthermore, the first dipole elements 106*a*, 108*a* are electrically grounded to the base plate 104. Inasmuch as such electrical grounding may be counter-intuitive to conventional antenna design, it will be appreciated that monopole antennas are not suitable due to the height requirements of the radiators. Similar to the length requirements, the height requirements are once again a function of wavelength. Since the maximum height of the housing/canister 104 is only six inches (6.0"), the inventors were challenged to develop a radiator which propagates a relatively long wavelength while at the same time maintaining a small design envelope. As a consequence, the inventors decided to combine the principals of a ¼ wave stub (typically employed to alter the impedance in a coaxial cable) with the low-band, dipole elements 106*a*, 108*a* of each of the radiators 106, 108. By electrically connecting the dipole elements 106*a*, 108*a* to the conductive base plate 104, a DC current may be fed directly into the ¼λ wavelength dipole elements 106*a*, 106*b*, 108*a*, 108*b* to transform a short circuit into an open circuit. This configuration has no adverse effect on the quality of the electrical signals on the lines, yet allows for a significant reduction in vertical dimension of the canister.

In the described embodiment, the dipole elements 106*a*, 106*b*, 108*a*, 108*b* comprise one or more laminates of a fiber-reinforced, resin matrix material having a metallic layer bonded to, or interposing the layers of, the composite laminate. The first dipole elements 106*a*, 108*a*, which are longer than the second dipole elements 106*b*, 108*b*, include a metallic trace 112*a*, 114*a* (shown in phantom lines) extending along the outer periphery of the first dipole elements 106*a*, 106*b*. The trace 112*a*, 114*a* projects downwardly at the outboard end 115*a* of each of the elements 106*a*, 108*a* for soldering to, and producing an electrical connection between a conductive brass fitting 116 in the base plate 104 and the metallic trace 112*a*, 114*a*. As mentioned in the preceding paragraph, the trace 114 grounds the dipole elements 106*a*, 108*a* while also extending along an outboard edge to reflect RF energy in a desired direction.

In addition to projecting orthogonally from the conductive base plate 104, the first and second dipole elements 106*a*, 106*b*, 108*a*, 108*b* intersect along vertical lines 120, 122 oriented normal to the plane of the base plate 104. The dipole elements 106*a*, 106*b*, 108*a*, 108*b* of each broadband radiator 106, 108, i.e., the first and second pole elements 106*a*, 106*b* of the first broadband radiator 106 and the first and second dipole elements 108*a*, 108*b* of the second broadband radiator 108 cross in a mid-span region to form a generally cruciform shape. In FIG. 3, the first and second dipole elements 106*a*, 106*b* of the first broadband radiator 106, and the first and second dipole elements 108*a*, 108*b* of the second broadband radiator 108 each include a vertical slot 126*a*, 126*b* and 128*a*, 128*b*, respectively, formed along each of the vertical lines 120, 122. The slots 126*a*, 128*a*, 126*b*, 128 extend from the upper or lower edges 130*u*, 1301, 132*u*, 1321 of the respective dipole elements 106*a*, 106*b*, 108*a*, 108*b* to the center of the respective element such that the elements 106*a*, 106*b*, 108*a*, 108*b* nest as the slots 130*u*, 1301, 132*u*, 1321 of each are engaged. While the first and second dipole elements 106*a*, 106*b*, 108*a*, 108*b* may form an acute or obtuse angle relative to each other, they preferably are orthogonal, forming a right angle along the vertical lines 120, 122.

In FIGS. 2 and 3, the telecommunications antenna includes first and second dipole elements 106*a*, 106*b*, 108*a*, 108*b* which are selectively tuned such that the first dipole elements 106*a*, 108*a* are longer than the respective second dipole elements 106*b*, 108*b*. In one embodiment, the first dipole elements 106*a*, 108*a*, correspond in size, i.e., in length, to about ¼ (λ), wherein the wavelength (λ) corresponds to a frequency (v) which is less than about one-thousand seven hundred megahertz (1700 mHz). The second dipole elements 106*b*, 108*b* correspond in size, i.e., in length, to about ¼ (λ), wherein the wavelength (λ) corresponds to a frequency (v) which is greater than or equal to about one-thousand seven hundred megahertz (1700 MHz).

In another embodiment, the first dipole elements 106*a*, 108*a*, have a length corresponding in size to a frequency (v) which is less than about one-thousand megahertz (1000 MHz). In the same embodiment, the second dipole elements 106*b*, 108*b* have a length corresponding in size to a frequency (v) which is greater than or equal to about one-thousand seven hundred megahertz (1700 MHz).

In yet another embodiment, the first dipole elements 106*a*, 108*a*, correspond in size) i.e., ¼ (λ), to a frequency (v) of about eight-hundred twenty-five mega-hertz (825 MHz), which is the average frequency in the low broadband range. This range extends from about six hundred and ninety mega-hertz (690 MHz) to about nine hundred and sixty mega-hertz (960 MHz). The second dipole elements 106*b*, 108*b* correspond in size, i.e., ¼ (λ), to a frequency (v) of about two-thousand, two-hundred and ninety-five mega-hertz (2295 MHz), which is the average frequency in the high broadband range. This range extends from about one-thousand six-hundred and ninety-five mega-hertz (1695 MHz) to about two-thousand six-hundred and ninety mega-hertz (2690 MHz).

Figure 4:
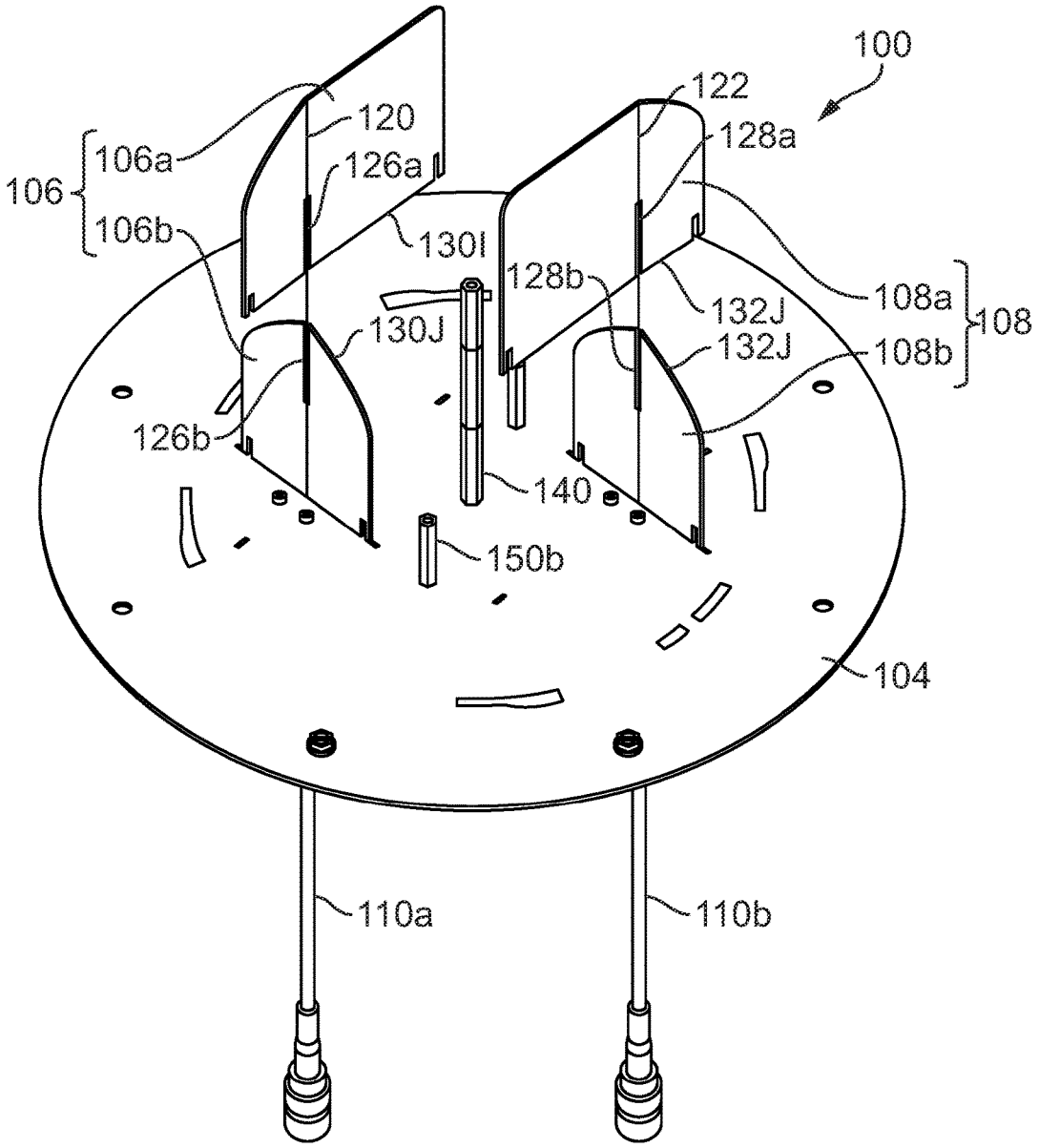
FIG. 4 is a perspective view of the telecommunications antenna shown in FIG. 2 which is partially exploded to view the assembly of the broadband radiators.

In the embodiment shown in FIGS. 2-4, the first dipole and second dipole elements 106*a*, 106*b*, 108*a*, 108*b* are spatially separated to minimize the overall size of the envelope while minimizing the electrical coupling therebetween. In the described embodiment, the dipole assemblies or broadband radiators 106, 108 are separated by a distance greater than at least three-tenths of the largest wavelength 0.3(λ) corresponding to the resonant frequency to which the dipole assemblies 106, 108 are tuned. The second dipole elements 106*b*, 108*b*, which have the shortest wavelengths and the greatest propensity for cross-coupling, are spaced farther apart than the first dipole elements 106*a*, 108*a*. In the described embodiment, isolation standoffs 140, 150*a*, 150*b* are interposed between the first and second dipole elements 106*a*, 106*b*, 108*a*, 108*b* of the dipole assemblies 106, 108. A low-band standoff 140 is disposed midway between the first dipole elements 106*a*, 108*a*. Further, a pair of high-band standoffs 150*a*, 150*b* are disposed between each outwardly facing leg of the first dipole elements 106*a*,108*a* and each inwardly facing leg of the second dipole elements 106*b*. 108*b*. The isolation standoffs 140, 150*a*, 150*b* have the effect of re-directing electrical current such that isolation is maximized between the broadband radiators 106, 108.

Prior art telecommunications antenna configurations have struggled to achieve greater than about ten decibels (10 Dbi) of isolation between the radiators. The configuration of the present invention more than doubles the isolation between antennas due to the configuration and orientation of the broadband radiators 106, 108. That is, the telecommunications antenna of the present description results in about twenty-one decibels (21 Dbi) of isolation. Inasmuch as the telecommunications antenna mitigates electrical coupling between the broadband radiators 106, 108, interference is also minimized while maximizing isolation.

Figure 5:
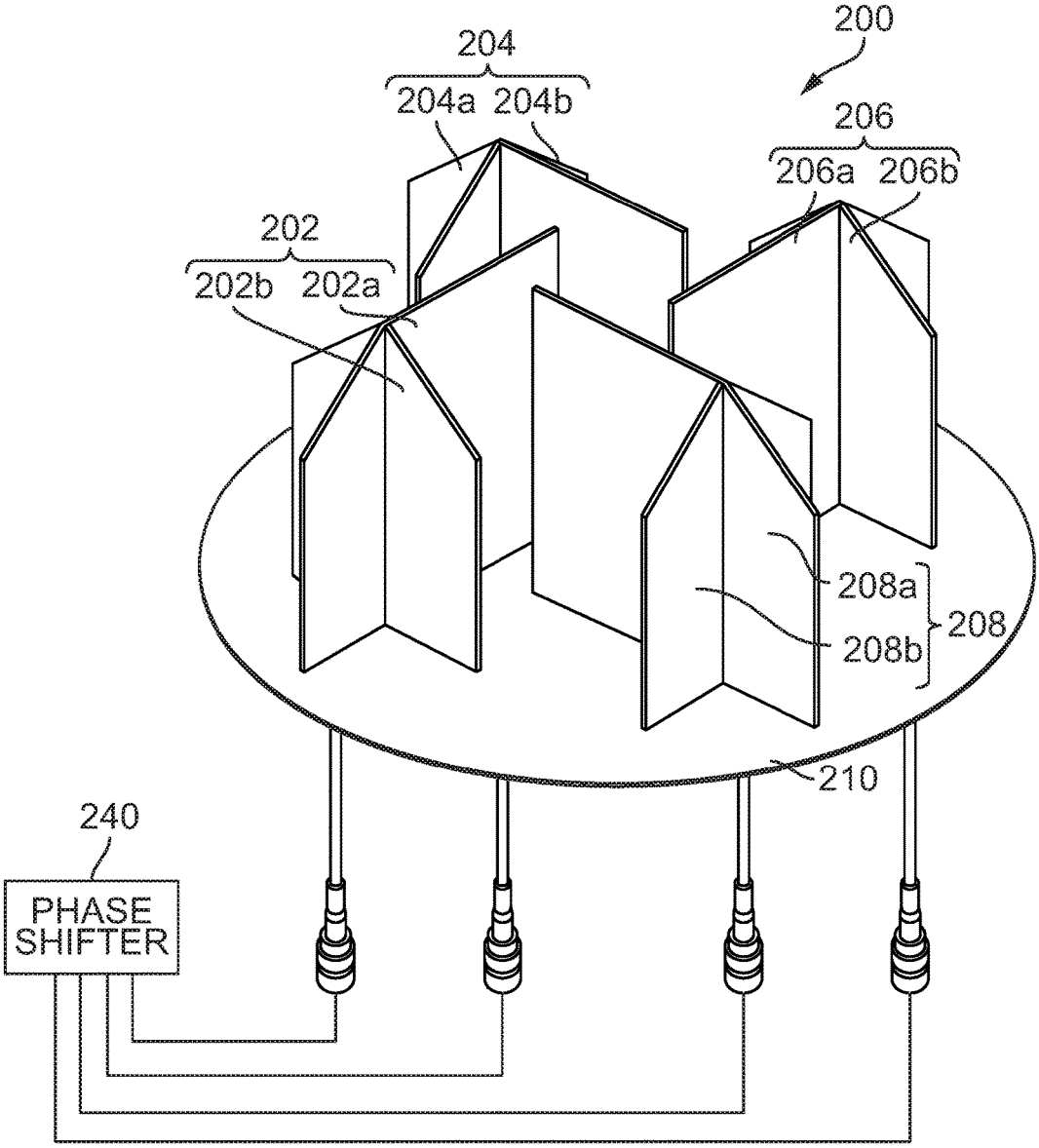
FIG. 5 is a perspective view of a directional telecommunications antenna employing two pairs of broadband radiators, each employing first and second dipole elements tuned to low and high broadband frequencies, respectively.
Figure 6:
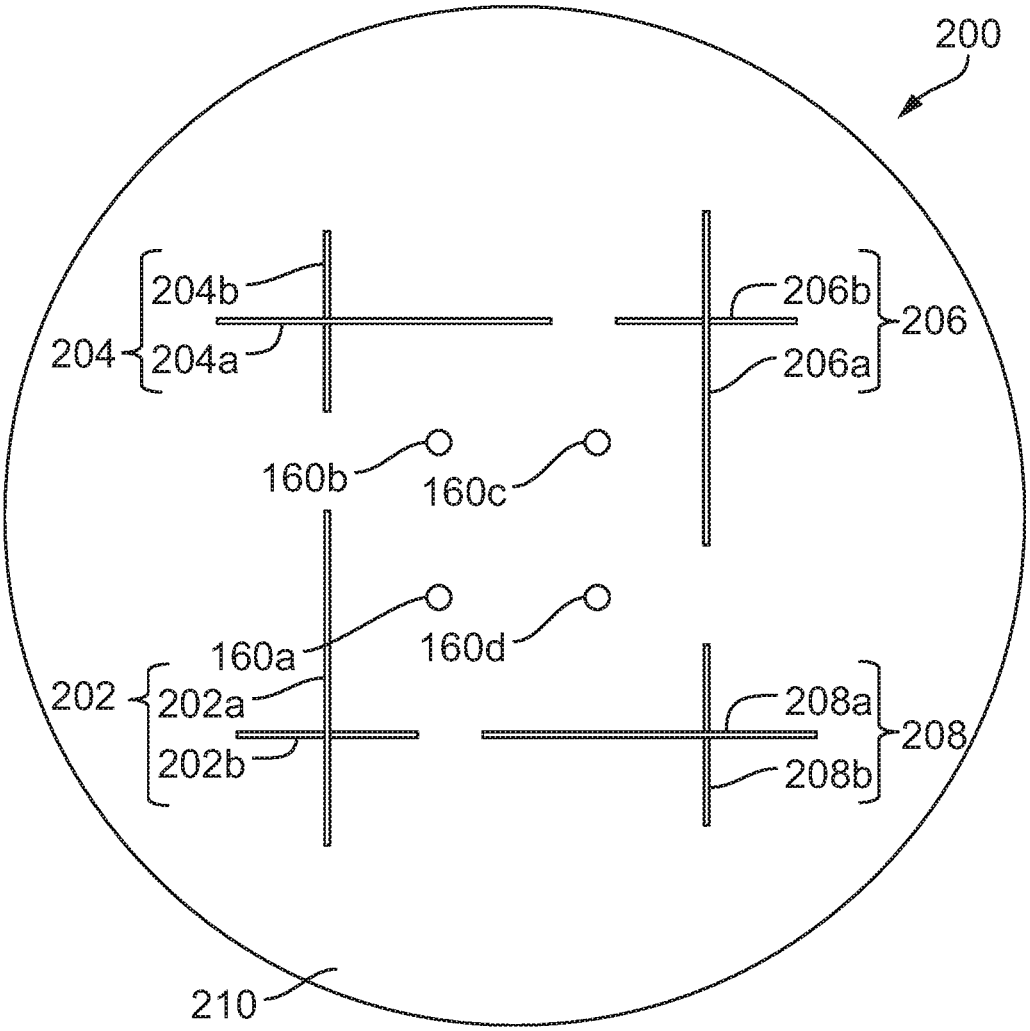
FIG. 6 is a top view of the directional telecommunications antenna, wherein the first dipole elements are disposed at right angles relative to the second dipole elements of the same broadband radiator, wherein the first and second dipole elements of each broadband radiator are orthogonal to minimize electrical couplings therebetween, and wherein the telecommunications antenna further comprises a phase shifter to increase the signal gain along a vector to produce a directional quality to the transmitted/received RF signals.

FIGS. 5 and 6 depict a telecommunications antenna 200 having a phase shifter 240 to provide a directional beam pattern over a specific geographic region. In the described embodiment, the telecommunications antenna 200 includes at least two pairs, or four broadband radiators 202, 204, 206, 208 each exchanging signals in a ninety-degree (90°) quadrants of a desired geographic sector. Each of the broadband radiators 202, 204, 206, 208 includes a first dipole element 202*a*, 204*a*, 206*a*, 208*a*, respectively, resonant in a low-band frequency range and a second dipole element 202*b*, 204*b*, 206*b*, 208*b*, respectively, resonant in a high-band frequency range. The broadband radiators 202, 204, 206, 208 are mounted, and electrically connected, to a conductive ground plane 210. As mentioned hereinbefore, the low-band frequency range corresponds in size, i.e., ¼ (λ), to a frequency (v) of about eight-hundred twenty-five mega-hertz (825 MHz), which is the average frequency in the low broadband range. This range extends from about six hundred and ninety mega-hertz (690 MHz) to about nine hundred and sixty mega-hertz (960 MHz). The second dipole elements 106*b*, 108*b* correspond in size to a frequency (v), i.e., ¼ (λ), of about two-thousand, two-hundred and ninety-five mega-hertz (2295 MHz), which is the average frequency in the high broadband range. This range extends from about one-thousand six-hundred and ninety-five mega-hertz (1695 MHz) to about two-thousand six-hundred and ninety mega-hertz (2690 MHz).

In this embodiment, at least one of the first dipole elements 202*a*, 204*a*, 206*a*, 208*a* of one of the broadband radiators 202, 204, 206, 208 is substantially orthogonal to the one of the first dipole elements 202*a*, 204*a*, 206*a*, 208*a* of the other of the broadband radiators 202, 204, 206, 208. Furthermore, the embodiment also shows that both the first and second dipole elements 202*a*, 204*a*, 206*a*, 208*a*, 202*b*, 204*b*, 206*b*, 208*b* of one of the broadband radiators 202, 204, 206, 208 are substantially orthogonal to the respective one of the first and second dipole elements 202*a*, 204*a*, 206*a*, 208*a*, 202*b*, 204*b*, 206*b*, 208*b* of the other of the dipole broadband radiators 202, 204, 206, 208. By arranging the low band resonators orthogonally relative to each other as well as the high band resonators, electrical couplings are mitigated. That is, since electrical couplings are magnified when dipole elements are in parallel, by arranging the elements orthogonally or at right angles, electrical couplings are diminished. Moreover, interference is also diminished by minimizing electrical coupling between the broadband radiators 202, 204, 206, 208.

Similar to the earlier embodiment, the directional telecommunications antenna 200 includes isolation standoffs 160*a*, 160*b*, 160*c*, 160*d* interposed between the first and second dipole elements 202*a*, 204*a*, 206*a*, 208*a*, 202*b*, 204*b*, 206*b*, 208*b* of the broadband radiators 202, 204, 206, 208. 106, 108. The isolation standoffs 160*a*, 160*b*, 160*c*, 160*d* have the effect of re-directing electrical current such that isolation is maximized between the broadband radiators 202*a*, 204*a*, 206*a*, 208*a*, 202*b*, 204*b*, 206*b*, 208*b*.

Figure 7:
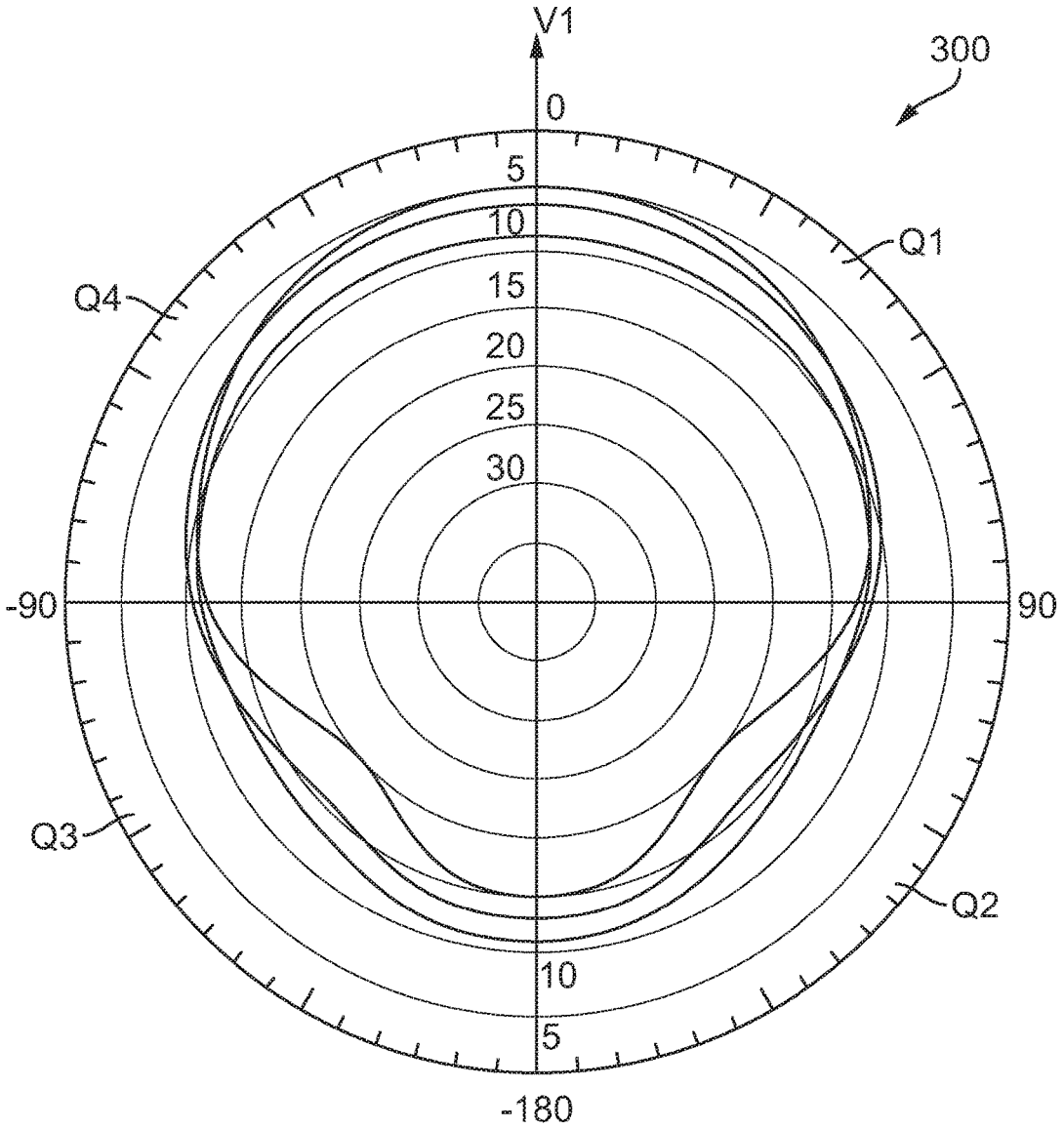
FIG. 7 depicts the signal output of the directional telecommunications antenna shown in FIGS. 5 and 6, wherein the signal is directional along one or more forward vectors.

A phase shifter is employed to electronically shift the direction of the beam by altering the gain along a vector V1. The gain can be altered in each quadrant: QI (0 to 90), Q2 (90 to 180), Q3 (−180 to −90) and Q4 (−90 to 0) to produce a beam pattern which resembles the output pattern 300 shown in FIG. 7. Therein, it can be seen how the gain shifts coverage to increase the volumetric area in quadrants Q1 and Q4 from quadrants Q2 and Q3.

Additional embodiments include any one of the embodiments described above, where one or more of its components, functionalities or structures is interchanged with, replaced by or augmented in combination with one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An antenna operative to exchange signals in the broadband range of the electromagnetic spectrum, comprising:

a conductive ground plane;

a pair of broadband radiators mounted to the conductive ground plane;

each pair of broadband radiators including first and second dipole elements having a length dimension and defining intersecting planes which cross along at least two points, the first dipole element tuned to a first broadband frequency and the second dipole element tuned to a second broadband frequency, the length dimension of the first dipole element being longer than the length dimension of the second dipole element;

wherein a straight line connecting the at least two points produce a line of intersection which is normal to the conductive ground plane, wherein each of the first dipole elements of the broadband radiators defines a long segment to one side of the line of intersection and a short segment to the other side of the line of intersection such that that each first dipole element is asymmetric, and wherein at least the first dipole element of one of the pairs of broadband radiators is spatially positioned relative to the respective first dipole element of the other of the pairs of broadband radiators to minimize electrical coupling therebetween.

2. The antenna of claim 1 wherein the first and second dipole elements of one broadband radiator are spatially positioned relative to the respective first and second dipole elements of the other broadband radiator to minimize electrical coupling therebetween.

3. The antenna of claim 1 wherein one of the first and second dipole elements of one of the broadband radiators is substantially orthogonal to the one of the first and second dipole elements of the other of the broadband radiators.

4. The antenna of claim 1 wherein both of the first and second dipole elements associated with one of the broadband radiators are substantially orthogonal to the respective first and second dipole elements of the other of the broadband radiators.

5. The antenna of claim 1 wherein the first and second dipole elements are arranged in a cruciform configuration.

6. The antenna of claim 1 wherein the first and second dipole elements of each pair of broadband radiators are substantially orthogonal to the conductive ground plane.

7. The antenna of claim 1 wherein the first dipole element of one broadband radiator is substantially orthogonal to the second dipole element of the same broadband radiator.

8. The antenna of claim 1 wherein the first broadband frequency is within a range which is less than about one-thousand seven hundred megahertz (1700 MHz), and wherein the second broadband frequency is within a range which is greater than or equal to about one-thousand seven hundred megahertz (1700 MHz).

9. The antenna of claim 8 wherein the first broadband frequency is within a range which is less than about one-thousand megahertz (1000 MHz).

10. The antenna of claim 1 further comprising a phase shifter operatively coupled to each broadband radiator for directionally increasing the gain to improve reception and reduce interference in a particular geographic sector.

11. The antenna of claim 1 further comprising at least two pairs of broadband radiator wherein each broadband radiator transmits/receives signals in a ninety-degree (90°) quadrant in a particular geographic sector.

12. The antenna of claim 1 further comprising at least one isolation standoff is disposed between the broadband radiators to redirect the flow of electric current around the dipole elements.

13. The antenna of claim 1 wherein the long segment of each of the first dipole elements is radially outboard of the short segment.

14. A telecommunications antenna for use in combination with a Multiple Input Multiple Output (MIMO) antenna, comprising:

a conductive ground plane;

a first dipole element mounted, and electrically connected, to the conductive ground plane and having a length tuned to a first broadband frequency;

a second dipole element mounted, and electrically connected, to the conductive ground plane and having a length dimension tuned to a second broadband frequency higher than the first broadband frequency; and wherein the first and second dipole elements define intersecting planes crossing along at least two points, wherein a straight line connecting the at least two points produce a line of intersection which is normal to the conductive ground plane, wherein the first dipole element crosses the second dipole element such that a long segment is disposed on one side of the line of intersection and a short segment is disposed on the other side of the line of intersection such that the first dipole element is asymmetric, and wherein the length of the second dipole element is longer than the length of the first dipole element.

15. The telecommunications of claim 14 wherein the first and second dipole elements are arranged in a cruciform configuration.

16. The telecommunications of claim 14 wherein the first and second dipole elements of the broadband radiator are substantially orthogonal to each other.

17. The telecommunications antenna of claim 14 wherein the first and second dipole elements of the broadband radiator are substantially orthogonal to the conductive ground plane.

18. The telecommunications antenna of claim 14 wherein the first broadband frequency is within a range which is less than about one-thousand seven hundred megahertz (1700 MHz), and wherein the second broadband frequency is within a range which is greater than or equal to about one-thousand seven hundred megahertz (1700 MHz).

19. The telecommunications antenna of claim 14 wherein the first broadband frequency is within a range which is less than about one-thousand megahertz (1000 MHz).

20. The telecommunications antenna of claim 14 further comprising a phase shifter operatively coupled to the broadband radiator for directionally increasing the gain to improve reception and reduce interference in a particular geographic sector.

21. The telecommunications of claim 14 wherein the long segment of the first dipole element is radially outboard of the short segment.

* * * * *